US010428640B1

(12) United States Patent
Osadchuk et al.

(10) Patent No.: US 10,428,640 B1
(45) Date of Patent: Oct. 1, 2019

(54) BOREHOLE MAPPING TOOL AND METHODS OF MAPPING BOREHOLES

(71) Applicant: OZZIE'S ENTERPRISES LLC

(72) Inventors: Dwayne Osadchuk, Scottsdale, AZ (US); Ryan Littlefield, Scottsdale, AZ (US)

(73) Assignee: Ozzie's Enterprises LLC, Scottsdale, AZ (US)

( * ) Notice: Subject to any disclaimer, the term of this patent is extended or adjusted under 35 U.S.C. 154(b) by 0 days.

(21) Appl. No.: 16/248,333

(22) Filed: Jan. 15, 2019

Related U.S. Application Data

(63) Continuation of application No. 16/160,108, filed on Oct. 15, 2018, now abandoned.

(51) Int. Cl.
*E21B 47/01* (2012.01)
*E21B 7/18* (2006.01)

(52) U.S. Cl.
CPC ..... *E21B 47/01* (2013.01); *E21B 7/18* (2013.01)

(58) Field of Classification Search
CPC .... E21B 47/022; E21B 47/08; E21B 47/0905; E21B 47/02216; E21B 47/026; E21B 47/082; E21B 47/122; E21B 47/011; E21B 47/01
USPC ..... 166/250.11
See application file for complete search history.

(56) References Cited

U.S. PATENT DOCUMENTS 3,474,879 A * 10/1969 Adair ..... E21B 47/082 181/104
4,524,324 A 6/1985 Dickinson, III
4,902,976 A * 2/1990 Belshaw ..... E21B 47/0905 166/66.5
5,047,635 A * 9/1991 Leaney ..... E21B 47/011 250/254
5,295,548 A * 3/1994 Yuasa ..... E21B 47/01 175/40
5,816,226 A 10/1998 Jernigan et al.
6,084,403 A * 7/2000 Sinclair ..... G01B 7/06 166/255.1
6,160,762 A * 12/2000 Luscombe ..... G01H 9/004 367/149

(Continued)

FOREIGN PATENT DOCUMENTS

CA 2484104 A1 * 4/2006 ..... E21B 47/022
GB 2029963 A 3/1980

(Continued)

OTHER PUBLICATIONS

PCT International Search Report and Written Opinion, corresponding to PCT/US2018/056025, dated Jan. 15, 2019, 8 pages.

*Primary Examiner* — Jennifer H Gay
(74) *Attorney, Agent, or Firm* — Fennemore Craig, P.C.

(57) ABSTRACT

A borehole mapping tool may include a probe casing having first and second ends that is sized to receive at least one location probe. An outer casing sized to be closely received by a borehole surrounds the probe casing so that an interior space is defined therebetween. A first end cap is mounted to a first end of the outer casing so that the first end of the probe casing extends beyond the first end cap. A second end cap is mounted to a second end of the outer casing so that the second end of the probe casing extends beyond the second end cap.

20 Claims, 5 Drawing Sheets

(56) References Cited

U.S. PATENT DOCUMENTS 6,305,944 B1 * 10/2001 Henry ..... E21B 17/01 439/13
6,597,177 B1 * 7/2003 Amini ..... G01V 3/28 324/339
6,928,864 B1 * 8/2005 Henry ..... E21B 17/023 166/54.1
8,002,031 B2 * 8/2011 De Kimpe ..... E21B 47/01 166/250.01
2002/0079136 A1 * 6/2002 Mercer ..... E21B 47/02216 175/45
2003/0179651 A1 * 9/2003 Nutt ..... G01V 1/40 367/25
2004/0065437 A1 * 4/2004 Bostick, III ..... E21B 47/011 166/250.01
2006/0075645 A1 * 4/2006 Seigel ..... E21B 47/022 33/313
2007/0247328 A1 * 10/2007 Petrovic ..... G01V 11/002 340/853.7
2007/0295502 A1 * 12/2007 Watson ..... E21B 43/128 166/254.2
2010/0155139 A1 * 6/2010 Kuckes ..... E21B 47/02216 175/45
2012/0006109 A1 * 1/2012 Andersen ..... E21B 17/1021 73/152.54
2012/0268135 A1 * 10/2012 Marsala ..... G01V 3/30 324/338
2014/0124269 A1 * 5/2014 Logan ..... E21B 47/011 175/325.1
2014/0238669 A1 * 8/2014 Odashima ..... B05B 5/081 166/250.11
2014/0352422 A1 * 12/2014 Paulsson ..... E21B 47/01 73/152.58
2015/0267481 A1 * 9/2015 Logan ..... E21B 7/04 175/40
2015/0285062 A1 * 10/2015 Logan ..... E21B 47/122 175/40
2015/0315900 A1 * 11/2015 Liu ..... E21B 47/011 175/40
2015/0330207 A1 * 11/2015 Logan ..... E21B 47/011 166/66
2016/0061024 A1 * 3/2016 Lubrecht ..... E21B 47/011 175/45
2018/0179889 A1 * 6/2018 Switzer ..... E21B 47/122

FOREIGN PATENT DOCUMENTS

GB 2122751 A 1/1984
WO WO-2018237059 A1 * 12/2018 ..... E21B 47/011

* cited by examiner

BOREHOLE MAPPING TOOL AND METHODS OF MAPPING BOREHOLES

CROSS-REFERENCE TO RELATED APPLICATION

This application is a continuation of U.S. patent application Ser. No. 16/160,108, filed on Oct. 15, 2018, now abandoned, which is hereby incorporated herein by reference for all that it discloses.

TECHNICAL FIELD

The present invention relates to directional drilling in general and more specifically to systems and methods for mapping boreholes formed by directional drilling.

BACKGROUND

Directional drilling, and more particularly, horizontal directional drilling, is a well-known technology that is used to form boreholes, typically for pipeline construction, although other applications are also known. In a typical pipeline construction application the directional drilling operation may be accomplished in three main stages. The first stage involves the drilling of a relatively small diameter pilot hole in the formation so that it follows a defined directional path established for the pipeline. The second stage, commonly referred to as a reaming stage, involves the use of a reamer to enlarge the size of the pilot hole to accommodate the desired pipeline. Depending the required final size of the borehole, several reaming steps may be required, with reamers of gradually increasing diameters being used to enlarge the borehole to the desired size. After the reaming stage, the pipeline may then be pulled back into the enlarged borehole to complete the process.

As mentioned, the pilot hole drilling apparatus is steerable or directable so that the pilot hole may be formed along the planned or desired pathway. Any of a wide range of steerable or directable drill strings and surveying techniques may be used for this purpose. While the pilot hole may follow the defined path within an acceptable tolerance, the subsequent reaming and pipe pulling operations may result in significant deviations from the path defined by the pilot hole, particularly if the pilot hole extends through formations of different types and properties.

For example, if the borehole traverses a rocky formation, it is possible that during the reaming process the borehole can 'walk' up to half the diameter of the final reamed size to get around a harder section of the rocky formation. In a sand or dirt hole, it is possible that a reamer can drop more than 3 meters from the path of the pilot hole. Both of these occurrences not only would place the pipeline in a different location than the desired pathway, but the undetected deviation may place added stress on the pipeline, thereby increasing the possibility of an in-service failure. Moreover, increasing constraints in pipeline development and the desire or necessity to place increasing numbers of pipelines in existing rights of way means that it is more important than ever to ensure that the installed pipeline does not deviate significantly from its planned path.

SUMMARY OF THE INVENTION

A borehole mapping tool for mapping a location of a borehole may include a probe casing having first and second ends that is sized to receive at least one location probe. An outer casing sized to be closely received by the borehole surrounds the probe casing so that an interior space is defined therebetween. A first end cap is mounted to a first end of the outer casing so that the first end of the probe casing extends beyond the first end cap. A second end cap is mounted to a second end of the outer casing so that the second end of the probe casing extends beyond the second end cap.

Another embodiment of a borehole mapping tool may include an outer casing having first and second ends, the outer casing being sized to be closely received by a borehole. A location probe is mounted within the outer casing. A first end cap is mounted to the first end of the outer casing whereas a second end cap is mounted to the second end of the outer casing.

A method for mapping a borehole is also disclosed that may include the steps of: Providing a borehole mapping tool comprising a location probe provided within an outer casing that is sized to be closely received by the borehole; positioning the borehole mapping tool within a first end of the borehole; moving the borehole mapping tool within the borehole; and producing a map of the borehole based on at least in part on data obtained from the location probe.

BRIEF DESCRIPTION OF THE DRAWINGS

Illustrative and presently preferred exemplary embodiments of the invention are shown in the drawings in which.

DETAILED DESCRIPTION OF THE PREFERRED EMBODIMENTS

Figure 1:
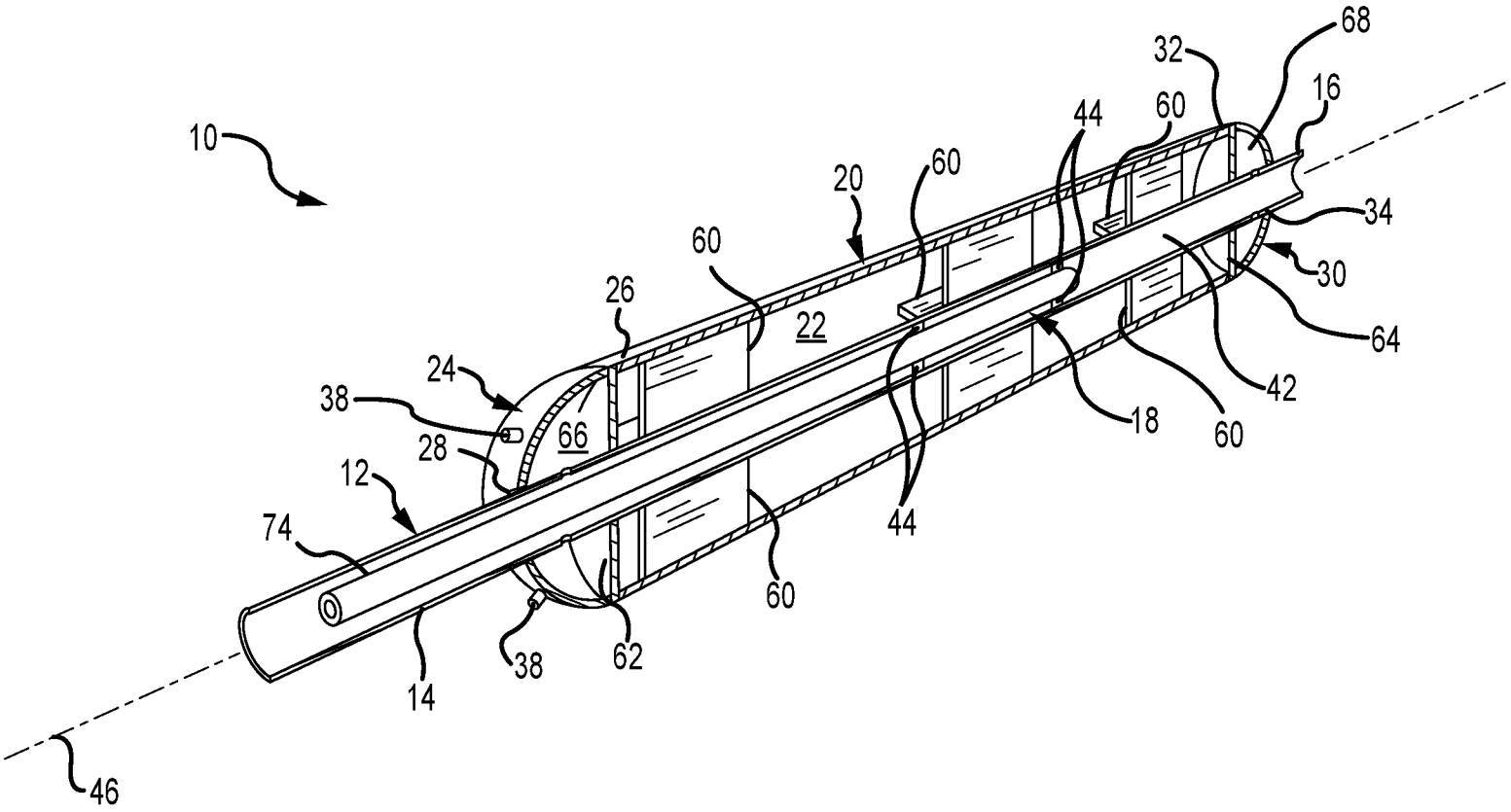
FIG. 1 is a perspective cross-sectional view of one embodiment of a borehole mapping tool according to the teachings provided herein.
Figure 2:
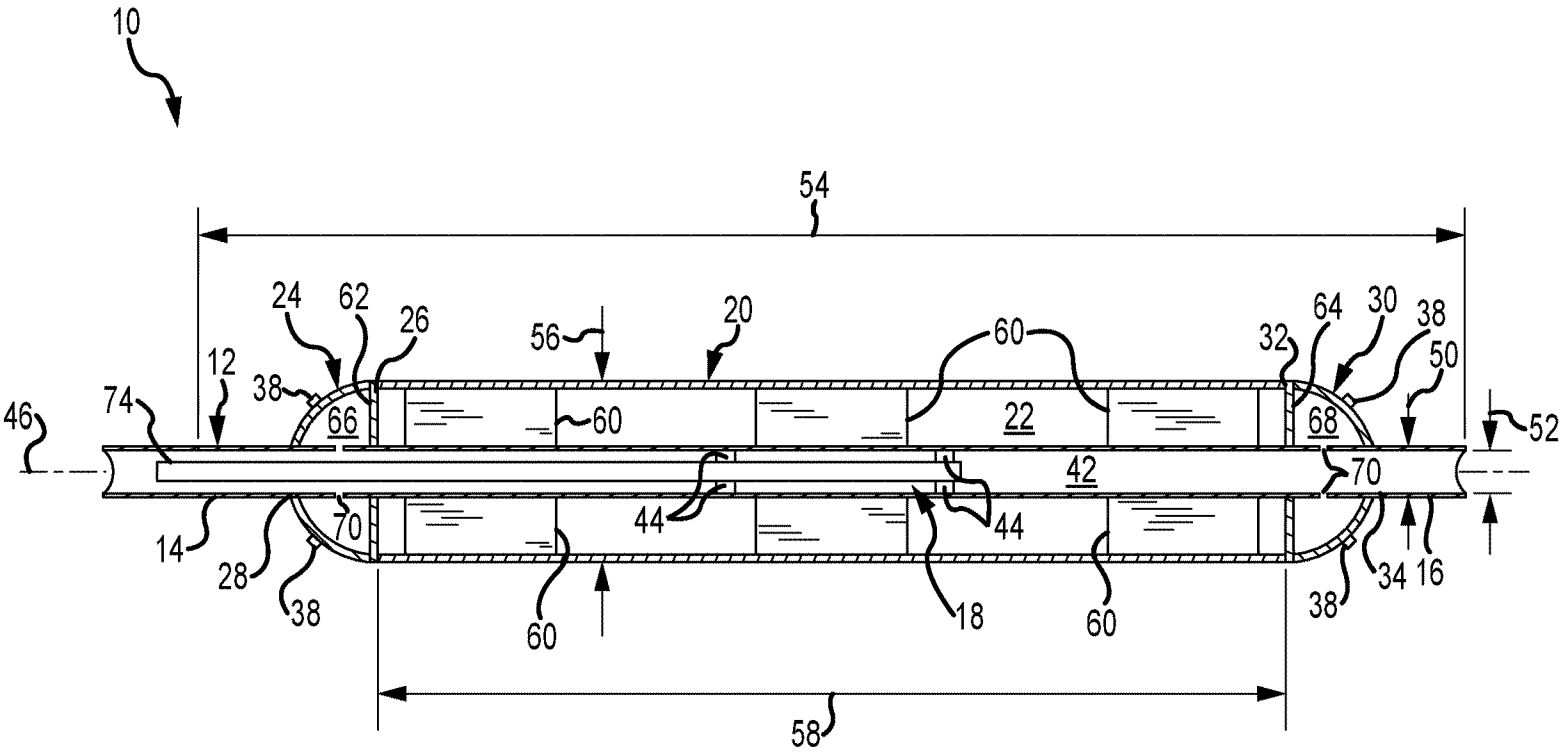
FIG. 2 is a cross-sectional in elevation of the borehole mapping tool illustrated in FIG. 1.

One embodiment of a borehole mapping tool 10 is best seen in FIGS. 1 and 2 and may comprise a probe housing or casing 12 having first and second ends 14 and 16. Probe casing 12 is sized to receive one or more location probes 18. The location probe(s) are operable, either alone or in conjunction with other equipment and devices (not shown), to determine the location of the probe(s) 18 with respect to any convenient coordinate or location system. Borehole mapping tool 10 may also comprise an outer housing or casing 20. The outer casing 20 may be mounted to the probe casing 12 so that an interior space or cavity 22 is defined between outer casing 20 and probe casing 12. As will be described in greater detail below, outer casing 20 may be sized to be closely received by the borehole 36 to be mapped, as best seen in FIG. 3.

Borehole mapping tool 10 may also comprise a first end cap 24 mounted to a first end 26 of outer casing 20. First end cap 24 may be provided with an opening 28 therein that is sized to receive the probe casing 12. The arrangement is such that the first end 14 of probe casing 12 extends beyond the first end cap 24. Similarly, borehole mapping tool 10 may also comprise a second end cap 30 mounted to a second end 32 of outer casing 20. Second end cap 30 may be provided with an opening 34 therein that is sized to receive the probe casing 12, again so that the second end 16 of probe casing 12 extends beyond the second end cap 30.

Figure 3:
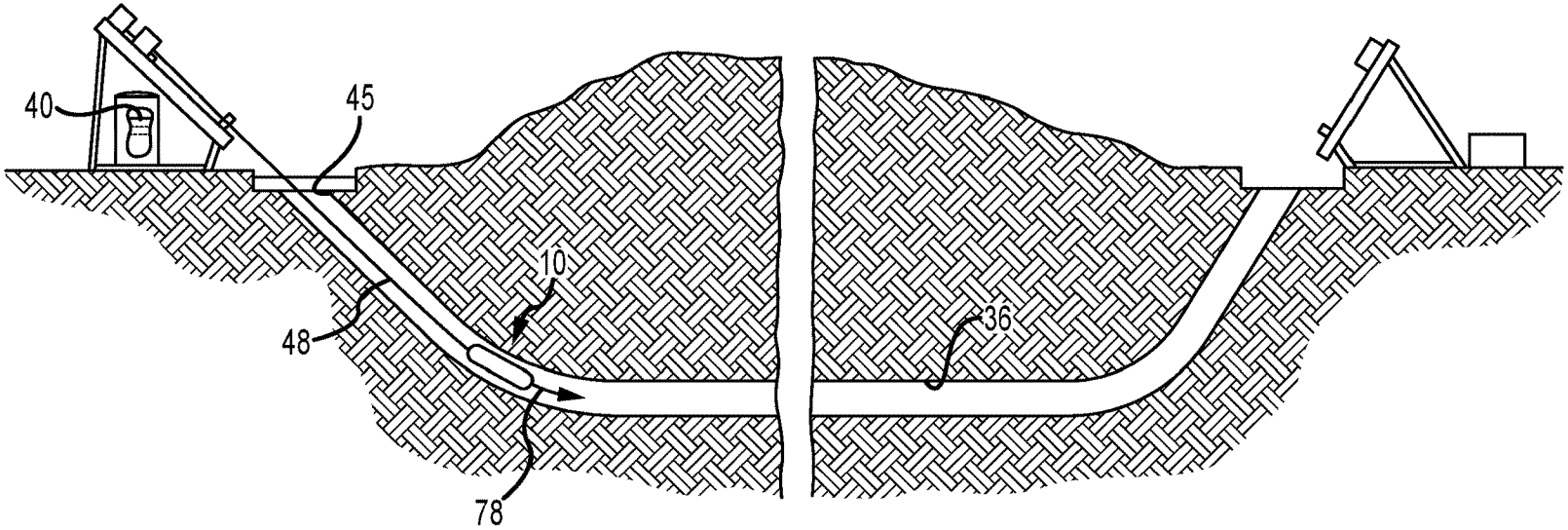
FIG. 3 is a schematic side view in elevation of a borehole with the borehole mapping tool provided therein.

In some embodiments, borehole mapping tool 10 may be provided with one or more nozzles 38 that are fluidically connected to a supply of drilling fluid 40 (FIG. 3). Nozzles 38 may be mounted to the first and second end caps 24 and 30, although other arrangements are possible. Drilling fluid 40 discharged from the nozzles 40 helps to lubricate the borehole mapping tool 10 as it moves within borehole 36, thereby reducing the forces required to move the borehole mapping tool 10 through borehole 36. Drilling fluid 40 may also assist in the dislodgement and removal of any loose or partially-excavated material that may remain in borehole 36. In one embodiment, the drilling fluid 40 may pumped through an interior conduit 42 defined by probe casing 12. The various nozzles 38 may be fluidically connected to the interior conduit 42 so that pressurized drilling fluid 40 contained therein is conducted to nozzles 38.

With reference now primarily to FIG. 3, the borehole mapping tool 10 may be used as follows to map the location of the borehole 36. Assuming that the borehole 36 is ready to receive the pipeline, i.e., that the pilot and reaming phases have been completed, the borehole mapping tool 10 may be positioned within a first end 45 of borehole 36. Thereafter, borehole mapping tool 10 may be attached to a drill string 48. At this point, the location probe(s) 18 provided within the borehole mapping tool 10 may be activated or otherwise energized so that they can determine the position of the borehole mapping tool 10 with respect to a suitable coordinate or location system. The borehole mapping tool 10 may then be moved through the borehole 36, e.g., by pushing or pulling on the drill string 48, while collecting and/or recording data from the location probe(s) 18. In embodiments wherein the location probe(s) 18 include magnetometers, the borehole mapping tool 10 may be stopped periodically to take magnetic locating shots. Such magnetic locating shots may be used as a second verification of the actual location of the borehole 36 within the formation. The collected sensor data along with the secondary magnetic locating shots may then be used to produce a map of the borehole 36.

Figure 4:
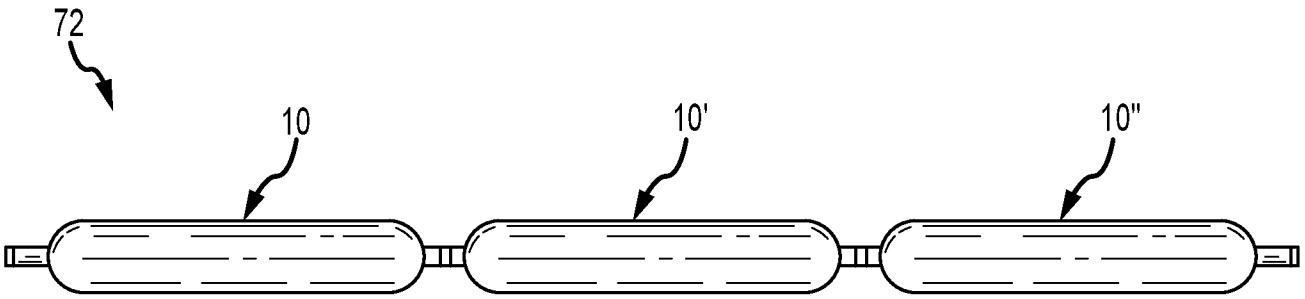
FIG. 4 is a side view in elevation of a borehole mapping tool string comprising 3 individual borehole mapping tools.
Figure 5:
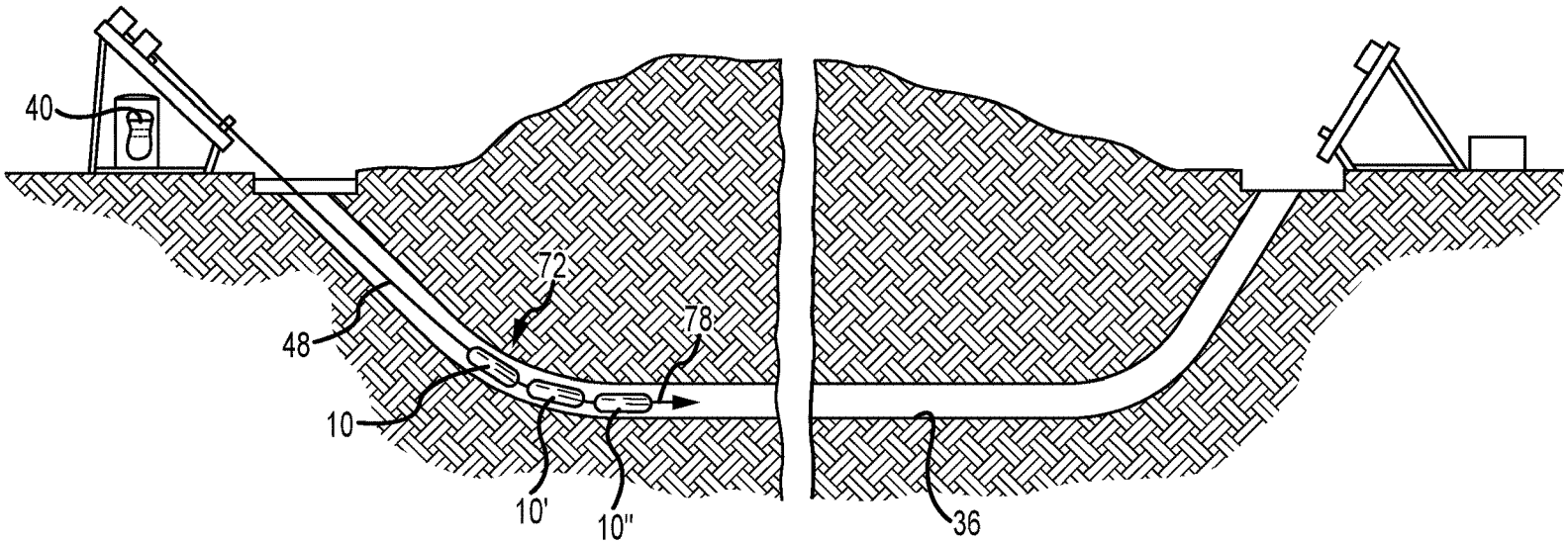
FIG. 5 is a schematic side view in elevation of a borehole having the borehole mapping tool string illustrated in FIG. 4 provided therein.

If desired, one or more reamers (not shown) may be mounted to either or both of the first and second ends 14 and 16 of borehole mapping tool 10. The use of such reamers may reduce the risk of borehole collapse or otherwise reduce the likelihood that the borehole mapping tool 10 will become stuck or jammed within borehole 36. In some applications, it may be advantageous to connect together multiple borehole mapping tools 10, 10', and 10" to create borehole mapping tool string 72, as best seen in FIGS. 4 and 5. The borehole mapping tool string 72 may then be pushed or pulled through the borehole 36 in the manner described herein in order to map the location of the borehole 36.

A significant advantage of the present invention is that it may be used to map the location of a completed borehole 36 to determine whether it accurately follows the planned or desired pathway. Significant deviations from the desired pathway may be detected and evaluated in advance of pipeline installation. If necessary or desirable, remedial measures may be taken to correct any significant deviations before the pipeline is installed. Besides ensuring that the installed pipeline will be located within an acceptable tolerance of the defined pathway, any deviations that would result in excessive deformations of the pipeline (e.g., resulting from a radius of curvature that is too small for the planned pipeline) also can be corrected, thereby significantly reducing the likelihood of subsequent in-service failures.

Still other advantages associated with the present invention include the ability to accurately map the centerline of the borehole 36. Such accurate mapping is the result of sizing the outer casing 20 so that it is closely received by the borehole 36. Because the location probe(s) 18 are located substantially along the centerline 46 of the borehole mapping tool 10, the resulting position data will correspond with the centerline of the borehole 36. No additional coordinate transformations or adjustments will be required.

Still other advantages are associated with the nozzles 38 that may be provided on the borehole mapping tool 10. The provision of drilling fluid 40 to the nozzles 38 during the mapping operation will help to reduce the forces required to move the borehole mapping tool 10 through the borehole 36. The drilling fluid 40 may also help to remove any remaining loose or partially-excavated material that may remain in the borehole 36. If one or more reamers (not shown) are mounted to the borehole mapping tool 10, the provision of drilling fluid 40 will also enhance the operation of the reamers, e.g., by providing lubrication, cooling, and removal of reamed material. If multiple borehole mapping tools 10, 10', and 10" are connected together to form a string 72, the resulting borehole map will generally be of increased accuracy. In addition, the use of a string 72 of multiple borehole mapping tools 10, 10', and 10" will speed the mapping process in that fewer stops will be required to perform the magnetic survey shots. Of course, the use of multiple borehole mapping tools 10 also will provide system redundancy in the event one or more of the locating probes fails or otherwise becomes inoperative during the mapping operation.

Having briefly described certain exemplary embodiments of systems and methods of the present invention, as well as some of its more significant features and advantages, various embodiments and variations of the present invention will now be described in detail. However, before proceeding the description, it should be noted that while various embodiments are shown and described herein as they could be used in a horizontal directional drilling operation to map the location of a reamed borehole in advance of pipeline installation, the present invention is not limited to use in such applications. For example, the methods and systems of the present invention could be used in any of a wide range of applications wherein it would be desirable to obtain a highly accurate map of an underground borehole. Consequently, the present invention should not be regarded as limited to use in any particular type of directional drilling operation, environment, or application.

Referring back now to FIGS. 1 and 2, one embodiment of the borehole mapping tool 10 may comprise an elongate, generally cylindrically-shaped structure defined primarily by probe casing 12, outer casing 20, and first and second end caps 24 and 30. As will be described in further detail below, it is generally preferred, but not required, to configure the borehole mapping tool so that it may be readily used with existing directional drilling equipment, such as drilling rigs, drill strings, and drilling fluid delivery systems.

In the particular embodiments shown and described herein, probe casing 12 may comprise a generally elongate, cylindrically-shaped member having a first end 14 and a second end 16. Probe casing 12 is hollow and defines an interior conduit 42 of sufficient size to receive one or more location probes 18. The location probes 18 may be mounted within the interior conduit 42 of probe casing 12 by means of one or more probe stabilizer members 44 so that the location probes 18 are located substantially along a central axis 46 of probe casing 12. In most embodiments, the interior conduit 42 of probe casing 12 will be fluidically connected to a supply of drilling fluid 40 via drill string 48. See FIG. 3.

In embodiments wherein the borehole mapping tool is configured to interface with a conventional drill string 48, probe casing 12 may be configured so that the first and second ends 14 and 16 thereof can be readily connected to drill string 28, e.g., by means of threaded connections. So configuring the probe casing 12 will also allow the borehole mapping tool 10 to be operatively connected to one or more reamers (not shown), which may be desirable in certain applications. In some embodiments, first end 14 of probe casing 12 may be provided with an orientation stub 76 to allow the borehole mapping tool to be connected to drill string 48.

The overall dimensions (e.g., diameter and overall length) of the probe casing 12 may comprise any of a wide range of values depending on the particular application and type of drilling equipment to be used. Consequently, the present invention should not be regarded as limited to probe casings 12 having any particular size. However, by way of example, in one embodiment, probe casing 12 may have an outside diameter 50 of about 17 cm (about 6.75 inches) and inside diameter 52 of about 10.2 cm (about 4 inches). Probe casing 12 may have an overall length 54 of about 8.5 m (about 28 feet).

Probe casing 12 may be fabricated from any of a wide range of materials, such as various metals and metal alloys, that are now known in the art or that may be developed in the future that are, or would be, suitable for the particular application. Consequently, the present invention should not be regarded as limited to any particular material. In embodiments wherein one or more of the location probes 18 utilize magnetometers, probe casing 12 should be fabricated from a non-magnetic material, such as non-magnetic stainless steel or Monel®. Monel is a registered trademark of the Huntington Alloys Corporation, Huntington, W. Va. (US) for metal alloys containing nickel and copper.

As mentioned, location probes 18 may be mounted within the interior cavity 42 defined by probe casing 12 so that the location probes 18 are located substantially along the central axis 46 of probe casing 12. By way of example, in one embodiment the location probes 18 may be mounted to probe casing 12 via a plurality of stabilizer members or 'spiders' 44, as best seen in FIG. 1. Location probe(s) 18 may also be mounted to a probe extender 74 to allow the location probe(s) 18 to be readily positioned at about the midpoint of probe casing 12.

Location probes 18 may comprise any of a wide range of downhole location probes or measurement-while-drilling (MWD) probes that are now known in the art or that may be developed in the future that are, or would be suitable, for mapping the location of the probe(s) 18, and by extension borehole mapping tool 10, as it moves within borehole 36. Location probe(s) 18 of the type suitable for use with the present invention typically involve a combination of accelerometers and magnetometers to provide the location functionality. Alternatively, other devices are known and may be used as well. However, because such location probes are well-known in the art and could be readily provided by persons having ordinary skill in the art after having become familiar with the teachings of the present invention, the particular location probe(s) 18, as well as any ancillary systems and devices that my be required for their operation, will not be described in further detail herein.

With reference now primarily to FIG. 2, borehole mapping tool 10 may also comprise an outer casing 20. In one embodiment, outer casing 20 may comprise an elongate, generally cylindrically-shaped member having a first end 26 and a second end 32. The outside diameter 56 of outer casing 20 is selected so that outer casing 20 will be closely received by the final, reamed borehole 36. See FIG. 3. Outer casing 20 may have an overall length 58 that is less than the overall length 54 of probe casing 12. This will allow the first and second ends 14 and 16 of probe casing 12 to extend beyond the outer casing 20, as best seen in FIG. 2. By way of example, in one embodiment, the outer casing 20 may have an outside diameter 56 of about 61 cm (about 24 inches) and an overall length 58, of about 5.5 m (about 18 feet).

Before proceeding with the description, it should be noted that, as used herein, the term 'closely received' should be understood to encompass a range of clearances between the outside diameter 56 of outer casing 20 and the diameter of the reamed borehole 36. The clearance should be sufficiently large so as to allow the borehole mapping tool 10 to move within the borehole 36 without a substantial likelihood that it will become stuck or jammed within the borehole 36. On the other hand, the clearance should not be so large as to permit the borehole mapping tool 10 to move within the borehole 36 by an amount that would exceed the allowable positional tolerance for a particular application. Moreover, and because the present invention could be used to map boreholes 36 having diameters ranging from a few centimeters to a few meters, and because the boreholes 36 could extend though a wide range of formations having a wide range of characteristics, from hard, rocky formations to soft, sandy formations, the present invention should not be regarded as limited to any particular clearance between the borehole 36 and the borehole mapping tool 10, expressed either as an absolute measurement or as a percentage or ratio between the diameters of the outer casing 20 and borehole 36.

Outer casing 20 may be fabricated from any of a wide range of materials, such as metals and metal alloys, that are now known in the art or that may be developed in the future that are, or would be, suitable for the particular application. In embodiments wherein one or more of the location probes 18 utilize magnetometers, then outer casing 20 should be fabricated from a non-magnetic material, such as non-magnetic stainless steel or Monel®.

Outer casing 20 may be mounted to or secured to probe casing 12 by a plurality of stabilizers or 'spiders' 60 extending between probe casing 12 and outer casing 20. See FIGS. 1 and 2. In the particular embodiments shown and described herein, each stabilizer 60 comprises a flat, generally plate-shaped member sized to extend between the two casing members 12 and 20. The stabilizers 60 may be attached to the two casing members 12 and 20 by any convenient means, such as by welding. In the particular embodiment illustrated in FIGS. 1 and 2, four (4) stabilizers or spiders 60 are mounted around probe casing 12 at 90° angles to one another. However, other embodiments may utilize a greater or lesser number of stabilizers 60. For example, another embodiment may use three (3) stabilizers 60 mounted around probe casing 12 spaced about 120° apart.

The various stabilizers 60 may be fabricated from any of a wide range of materials, such as metals and metal alloys, that are now known in the art or that may be developed in the future that are, or would be, suitable for the particular application. Here again, in embodiments wherein one or more of the location probes 18 utilize magnetometers, the various stabilizers 60 should be fabricated from non-magnetic materials, such as non-magnetic stainless steel or Monel®.

Borehole mapping tool 10 may also be provided with first and second end caps 24 and 30. End caps 24 and 30 close off the interior space 22 defined between the probe casing 12 and outer casing 20. End caps 24 and 30 also allow the borehole mapping tool 10 to more easily move through the borehole 36 during the mapping operation. With reference now primarily to FIGS. 1 and 2, first end cap 24 may be mounted to the first end 26 of outer casing 20. First end cap 24 may be provided with an opening 28 therein that is sized to receive probe casing 12. This will allow the first end 14 of probe casing 12 to extend beyond the first end cap 24. Second end cap 30 may be mounted to the second end 32 of outer casing 20. Second end cap 30 also may be provided with an opening 34 therein that is sized to receive the probe casing 12 so that the second end 16 of probe casing 12 extends beyond the second end cap 30.

First and second end caps 24 and 30 may comprise any of a wide range of shapes, such as conical, ellipsoidal, or hemispherical, to allow the borehole mapping tool to more easily move through borehole 36. By way of example, in one embodiment, the first and second end caps 24 and 30 are substantially hemispherical in shape.

First and second end caps 24 and 30 may be fabricated from any of a wide range of materials, such as metals and metal alloys, that are now known in the art or that may be developed in the future that are, or would be, suitable for the particular application. In embodiments wherein one or more of the location probes 18 utilize magnetometers, then first and second end caps 24 and 30 should be fabricated from non-magnetic materials, such as non-magnetic stainless steel or Monel®.

In many embodiments, the borehole mapping tool 10 may also be provided with one or more nozzles 38 that are fluidically connected to the supply of drilling fluid 40. In the particular embodiments shown and described herein, four (4) individual nozzles 38 are mounted to each of the first and second end caps 24 and 30, as best seen in FIGS. 1 and 2. Alternatively, the nozzles could be provided elsewhere on borehole mapping tool 10. As mentioned earlier, the various nozzles 38 are fluidically connected to the supply of drilling fluid 40 (FIG. 3). In embodiments wherein the drilling fluid 40 is supplied to the interior conduit 42 of probe casing 12, the various nozzles 38 may be fluidically connected to the interior conduit 42 of probe casing 12 via the first and second end caps 24 and 30. In such an embodiment, respective first and second isolation bulkheads 62 and 64 may be used to define respective first and second drilling fluid chambers 66 and 68 that are sealed or isolated from the interior space 22. Suitable openings 70 provided in the probe casing 12 to allow drilling fluid 40 in the interior conduit 42 to pass into the first and second drilling fluid chambers 66 and 68. Thereafter, the drilling fluid, which is under pressure, will be ejected from nozzles 38.

Nozzles 38 may comprise any of a wide range of drilling fluid nozzles that are readily commercially available and could be easily provided by persons having ordinary skill in the art after having become familiar with the teachings provided herein. Consequently, the nozzles 38 that may be used in one embodiment will not be described in further detail herein.

Referring now primarily to FIG. 3, the borehole mapping tool 10 may be used as follows to map the location of an underground borehole 36. Once the borehole 36 is ready to receive the pipeline, i.e., once the pilot and reaming phases have been completed, the borehole mapping tool 10 may be positioned within first end 45 of borehole 36 and attached to a drill string 48. The location probe(s) 18 provided within the borehole mapping tool 10 may then be energized or otherwise activated so that they can determine the position of the borehole mapping tool 10 with respect to the desired coordinate system. The borehole mapping tool 10 may then be moved through the borehole 36, e.g., by pushing the drill string 48 in the direction of arrow 78, while collecting and/or recording data from the location probe(s) 18. In this regard it should be noted that the borehole mapping tool 10 may be either pushed or pulled through borehole 36. In embodiments provided with drilling fluid nozzles 38, drilling fluid 40 may be pumped through drill string 48 and thence nozzles 38 to assist in the movement of tool 10 through borehole 36. In embodiments wherein the location probes include magnetometers, the borehole mapping tool 10 may be stopped periodically to take magnetic locating shots. Such magnetic locating shots may be used as a second verification of the actual location of the borehole 36. The collected sensor data along with the secondary magnetic locating shots may then be used to produce a map of the borehole 36 within the formation.

If desired, one or more reamers (not shown) may be mounted to either or both of the first and second ends 14 and 16 of borehole mapping tool 10. Drilling fluid 40 may be pumped through drill string 48 and nozzles 38 to assist the reamers. The use of such reamers may reduce the risk of borehole collapse or otherwise reduce the likelihood that the borehole mapping tool 10 will become stuck or jammed within borehole 36.

In some applications, it may be advantageous to connect multiple borehole mapping tools 10, 10', and 10" together to create borehole mapping tool string 72, as best seen in FIGS. 4 and 5. The tool string 72 may then be pushed or pulled through the borehole 36, e.g., in the direction indicated by arrow 78, in the manner described herein in order to map the location of the borehole 36. Drilling fluid 40 may be pumped through drill string 48 to assist in the movement of the tool string 72 through borehole 36. If desired, one or more reamers (not shown) may also be attached to tool string 72 to further assist the movement of the tool string 72 through borehole 36 during the mapping operation.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A borehole mapping tool for mapping a location of a borehole, comprising:

a probe casing having first and second ends, said probe casing sized to receive a location probe;

an outer casing having first and second ends, said outer casing surrounding said probe casing so that an interior space is defined between said outer casing and said probe casing, said outer casing being sized to be received by the borehole;

a first end cap mounted to the first end of said outer casing, said first end cap defining an opening therein that is sized to receive the first end of the probe casing so that the first end of said probe casing extends beyond said first end cap;

a second end cap mounted to the second end of said outer casing, said second end cap defining an opening therein that is sized to receive the second end of the probe casing so that the second end of said probe casing extends beyond said second end cap; and a drilling fluid nozzle operatively associated with said first end cap.

2. The borehole mapping tool of claim 1, further comprising a plurality of stabilizers positioned within the interior space defined between said probe casing and said outer casing, each of said plurality of stabilizers extending between said probe casing and said outer casing.

3. The borehole mapping tool of claim 1, wherein said probe casing defines an interior conduit therein that is adapted to be operatively connected to a supply of drilling fluid and wherein said drilling fluid nozzle is fluidically connected to the interior conduit defined by said probe casing so that drilling fluid in the interior conduit of said probe casing is conducted to said drilling fluid nozzle.

4. The borehole mapping tool of claim 1, wherein said probe casing and said outer casing comprise non-magnetic material.

5. The borehole mapping tool of claim 4, wherein said non-magnetic material comprises one or more selected from the group consisting of non-magnetic stainless steel alloys and non-magnetic nickel alloys.

6. A borehole mapping tool for mapping a location of a borehole, comprising:

a probe casing having first and second ends, said probe casing sized to receive a location probe;

an outer casing having first and second ends, said outer casing surrounding said probe casing so that an interior space is defined between said outer casing and said probe casing, said outer casing being sized to be received by the borehole;

a first end cap mounted to the first end of said outer casing, said first end cap defining an opening therein that is sized to receive the first end of the probe casing so that the first end of said probe casing extends beyond said first end cap;

a second end cap mounted to the second end of said outer casing, said second end cap defining an opening therein that is sized to receive the second end of the probe casing so that the second end of said probe casing extends beyond said second end cap;

a first isolation bulkhead defining a central opening therein sized to receive the first end of said probe casing, said first isolation bulkhead mounted between said first end cap and the first end of said outer casing, said first isolation bulkhead isolating the interior space defined between said outer casing and said probe casing from said first end cap; and a second isolation bulkhead defining a central opening therein sized to receive the second end of said probe casing, said second isolation bulkhead mounted between said second end cap and the second end of said outer casing, said second isolation bulkhead isolating the interior space defined between said outer casing and said probe casing from said second end cap.

7. The borehole mapping tool of claim 6, wherein said probe casing comprises an elongate, cylindrically-shaped member and wherein said outer casing comprises an elongate, cylindrically-shaped member.

8. The borehole mapping tool of claim 7, wherein the elongate, cylindrically-shaped probe casing has an outside diameter of 17 cm and length of 8.5 m.

9. The borehole mapping tool of claim 7, wherein the elongate, cylindrically-shaped outer casing has an outside diameter of 61 cm and a length of 5.5 m.

10. The borehole mapping tool of claim 7, wherein said first and second end caps comprise hemispherically shaped members and wherein said first and second isolation bulkheads comprise circular members.

11. A borehole mapping tool for mapping a location of a borehole, comprising:

an elongate, cylindrically-shaped probe casing having first and second ends, said probe casing defining an interior conduit therein;

a location probe positioned within the interior conduit defined by said probe casing;

an elongate, cylindrically-shaped outer casing having first and second ends, said outer casing surrounding said probe casing so that an interior space is defined between said outer casing and said probe casing, said outer casing having a diameter sized to be received by the borehole;

a first end cap mounted to the first end of said outer casing, said first end cap defining an opening therein that is sized to receive the first end of the probe casing so that the first end of said probe casing extends beyond said first end cap;

a first isolation bulkhead defining a central opening therein sized to receive the first end of said probe casing, said first isolation bulkhead mounted between said first end cap and the first end of said outer casing, said first isolation bulkhead isolating the interior space defined between said outer casing and said probe casing from said first end cap;

a second end cap mounted to the second end of said outer casing, said second end cap defining an opening therein that is sized to receive the second end of the probe casing so that the second end of said probe casing extends beyond said second end cap; and a second isolation bulkhead defining a central opening therein sized to receive the second end of said probe casing, said second isolation bulkhead mounted between said second end cap and the second end of said outer casing, said second isolation bulkhead isolating the interior space defined between said outer casing and said probe casing from said second end cap.

12. The borehole mapping tool of claim 11, further comprising a stabilizer mounted between said location probe and said probe casing, said stabilizer holding said location probe at about a center of the interior conduit defined by said probe casing.

13. The borehole mapping tool of claim 12, wherein said first and second end caps comprise hemispherically shaped members and wherein said first and second isolation bulkheads comprise circular members.

14. The borehole mapping tool of claim 11, wherein the interior conduit defined by said probe casing is adapted to be connected to a supply of drilling fluid, said borehole mapping tool further comprising:

a first drilling fluid nozzle mounted to said first end cap, said first drilling fluid nozzle being fluidically connected to the interior conduit defined by said probe casing so that drilling fluid in the interior conduit of said probe casing is conducted to said first drilling fluid nozzle; and a second drilling fluid nozzle mounted to said second end cap, said second drilling fluid nozzle being fluidically connected to the interior conduit defined by said probe casing so that drilling fluid in the interior conduit of said probe casing is conducted to said second drilling fluid nozzle.

15. A method of mapping a borehole, comprising:

providing a borehole mapping tool comprising a location probe provided within an outer casing and at least one drilling fluid nozzle positioned on an end cap thereof, said outer casing sized to be received by the borehole;

positioning the borehole mapping tool within a first end of the borehole;

connecting the borehole mapping tool to a supply of drilling fluid so that drilling fluid is sprayed from the drilling fluid nozzle;

moving the borehole mapping tool within the borehole; and producing a map of the borehole based on at least in part on data obtained from the location probe.

16. The method of claim 15, wherein said moving the borehole mapping tool within the borehole comprises moving the borehole mapping tool from a first end of the borehole to a second end of the borehole.

17. The method of claim 15, wherein the borehole mapping tool comprises a first borehole mapping tool and wherein said method further comprises:

providing a second borehole mapping tool comprising a location probe provided within an outer casing of said second borehole mapping tool, said outer casing sized to be received by the borehole;

attaching the second borehole mapping tool to the first borehole mapping tool;

moving the first and second borehole mapping tools within the borehole; and producing a map of the borehole based at least in part on data obtained from the location probes in the first and second borehole mapping tools.

18. The method of claim 17 further comprising:

providing a third borehole mapping tool comprising a location probe provided within an outer casing of said third borehole mapping tool, said outer casing sized to be received by the borehole;

attaching the third borehole mapping tool to the second borehole mapping tool;

moving the first, second, and third borehole mapping tools within the borehole; and producing a map of the borehole based at least in part on data obtained from the location probes in the first, second, and third borehole mapping tools.

19. The method of claim 15, further comprising:

stopping the borehole mapping tool within the borehole;

taking a magnetic location shot of the stopped borehole mapping tool to determine the position of the stopped borehole mapping tool; and resuming movement of the borehole mapping tool within the borehole.

20. The method of claim 15, further comprising:

mounting the borehole mapping tool to a borehole reamer and wherein said moving comprises moving the borehole mapping tool and the borehole reamer within the borehole.

* * * * *